US008298738B2

(12) United States Patent
Ieda

(10) Patent No.: US 8,298,738 B2
(45) Date of Patent: Oct. 30, 2012

(54) POSITIVELY-CHARGEABLE TONER FOR DEVELOPING ELECTROSTATIC IMAGE

(75) Inventor: Osamu Ieda, Tokyo (JP)

(73) Assignee: Zeon Corporation, Tokyo (JP)

( * ) Notice: Subject to any disclaimer, the term of this patent is extended or adjusted under 35 U.S.C. 154(b) by 366 days.

(21) Appl. No.: 12/525,860

(22) PCT Filed: Feb. 27, 2008

(86) PCT No.: PCT/JP2008/053413

§ 371 (c)(1),
(2), (4) Date: Aug. 5, 2009

(87) PCT Pub. No.: WO2008/105459

PCT Pub. Date: Sep. 4, 2008

(65) Prior Publication Data

US 2010/0330490 A1 Dec. 30, 2010

(30) Foreign Application Priority Data

Feb. 28, 2007 (JP) ..... 2007-050651

(51) Int. Cl.
*G03G 9/097* (2006.01)

(52) U.S. Cl. ..... 430/108.22; 430/108.6; 430/108.7; 430/110.3; 430/110.4

(58) Field of Classification Search ..... 430/108.6, 430/108.7, 108.22, 110.3, 110.4
See application file for complete search history.

(56) References Cited

U.S. PATENT DOCUMENTS

| | | | | |
|---|---|---|---|---|
| 4,840,863 | A * | 6/1989 | Otsu et al. | 430/108.22 |
| 5,547,802 | A * | 8/1996 | Kawase et al. | 430/108.24 |
| 2004/0219448 | A1* | 11/2004 | Kato et al. | 430/108.6 |
| 2006/0063085 | A1 | 3/2006 | Lee et al. | |
| 2006/0177754 | A1* | 8/2006 | Miyakawa et al. | 430/108.6 |
| 2006/0198663 | A1* | 9/2006 | Miyoshi et al. | 399/279 |
| 2006/0222995 | A1* | 10/2006 | Moriyama et al. | 430/122 |
| 2006/0269865 | A1* | 11/2006 | Oyama | 430/137.11 |

FOREIGN PATENT DOCUMENTS

| | | | |
|---|---|---|---|
| CN | 1752853 | A | 3/2006 |
| JP | 02-210366 | A | 8/1990 |
| JP | 08-339095 | A | 12/1996 |
| JP | 2004-287102 | A | 10/2004 |
| JP | 2005-128235 | A | 5/2005 |
| JP | 2006-330689 | A | 12/2006 |

OTHER PUBLICATIONS

Japanese Patent Office machine-assisted translation of Japanese Patent 08-339095 A (pub. Dec. 1996).*

Japanese Patent Office machine-assisted translation of Japanese Patent 08-339095 (pub. Dec. 1996).*

International Search Report of PCT/JP2008/053413, Mailing Date of Apr. 15, 2008.

Chinese Office Action dated Aug. 3, 2011, issued in corresponding Chinese Application No. 200880006444.9.

* cited by examiner

*Primary Examiner* — Janis L Dote
(74) *Attorney, Agent, or Firm* — Westerman, Hattori, Daniels & Adrian, LLP

(57) ABSTRACT

A positively-chargeable toner for developing electrostatic images which can prevent damage of photosensitive members and filming due to an external additive, can impart a stable charge property and flowability to toner particles over time, and thus hardly causes deterioration of image quality due to fog, blur, white streaks or the like, and therefore is excellent in printing durability even if continuous printing of plural prints is performed is provided. A positively-chargeable toner for developing electrostatic images of the present invention is a positively-chargeable toner for developing electrostatic images comprising colored resin particles containing a colorant and a binder resin, and an external additive, wherein the external additive contains magnesium silicate having negatively charging ability, with a Mohs hardness of 3 or less and a number average primary particle diameter in the range from 1 to 15 μm.

5 Claims, No Drawings

POSITIVELY-CHARGEABLE TONER FOR DEVELOPING ELECTROSTATIC IMAGE

TECHNICAL FIELD

The present invention relates to a positively-chargeable toner for developing electrostatic images (hereinafter, it may be simply referred to as "positively-chargeable toner" or "toner") used for development of latent electrostatic images in electrophotography, the electrostatic recording method, the electrostatic printing process or the like. Particularly, the present invention relates to a positively-chargeable toner for developing electrostatic images which prevents damage of photosensitive members and filming, hardly causes deterioration of image quality, and is excellent in printing durability.

BACKGROUND ART

Image-forming devices such as electrophotographic devices, electrostatic recording devices, electrostatic printing devices, and so on are applied to copying machines, printers, facsimile machines, complex machines thereof and so on. A method of forming a desired image by developing an electrostatic latent image formed on a photosensitive member with a toner for developing an electrostatic image is widely employed.

For example, generally, an electrophotographic device using electrophotography uniformly charges the surface of a photosensitive member generally formed of photoconductive material with any of the various means, and then, an electrostatic latent image is formed on the photosensitive member. Next, the electrostatic latent image is developed using a toner. After transferring an image of the toner on a recording material such as paper or the like if necessary, the image is fixed by heating or the like. Thus, a copy is obtained.

In recent years, as toners used for development, positively-chargeable toners applicable to the positive charging method are preferably used from the viewpoint of inhibiting ozone generation and obtaining the toners excellent in charge property.

In addition, generally, microparticles of an external additive are externally added (attached by addition) on the surface of the toner particles from the viewpoint of improving the charge property and flowability of toners.

However, in the process of continuous printing of plural images using a conventional external additive, microparticles of the external additive are buried on and/or released (detached) from the surface of toner particles due to mechanical stress in a development device, such as increase in number of contact of toner particles by agitation or the like, and thus decrease functions thereof as external additives. Thereby, conventional external additives are less likely to impart a stable charge property and flowability to toner particles over time.

The toner particles, the microparticles of the external additive being buried, and the microparticles of the external additive released (detached) from the surface of the toner particles may cause damage on photosensitive members, and filming due to the toner particles attaching to the surface of a photosensitive member. Thus, there are problems that deterioration of image quality due to fog, blur, white streaks or the like tends to occur, and printing durability of toners decreases upon continuous printing of plural prints.

With respect to the problems of deterioration of image quality due to the burial and release of the external additive, development of a toner is demanded, wherein the toner can maintain the state in which microparticles of an external additive are suitably attached to the surface of colored resin particles over time even if the number of contact of the toner particles by agitation or the like is increased in a development device in the process of continuous printing of plural prints.

Patent Literature 1 discloses a toner which can prevent damage of photosensitive members and filming by externally adding magnesium silicate, preferably forsterite, steatite or enstatite having a specific hardness (Mohs hardness) of 4.5 to 8, to the surface of toner particles as an external additive.

Patent Literature 2 discloses a toner which is formed by externally adding white filler particles, preferably talc, having a specific volume average particle diameter of 1 to 100 μm, to the surface of toner particles as an external additive, and thereby prevents damage of photosensitive members and soiling in non-image areas due to decrease in flowability and charge property of the toner particles.

In the toners disclosed in Patent Literatures 1 and 2, improvement of deterioration of image quality caused by burial and release of microparticles of an external additive has been attempted by defining the hardness and the particle diameter of the external additive. However, as a result of researches, the inventor of the present invention found out that the external additives used in Patent Literatures 1 and 2 do not necessarily have sufficient effect of preventing damage of photosensitive members and filming.

Patent Literature 1: Japanese patent Application Laid-open (JP-A) No. 2006-330689

Patent Literature 2: JP-A No. H8-339095

SUMMARY OF INVENTION

Technical Problem

An object of the present invention is to provide a positively-chargeable toner for developing electrostatic images which can prevent damage of photosensitive members and filming due to an external additive, can impart a stable charge property and flowability to toner particles over time, and thus hardly causes deterioration of image quality due to fog, blur, white streaks or the like, and therefore is excellent in printing durability even if continuous printing of plural prints is performed.

Solution to Problem

As a result of diligent researches made to attain the above object, the inventor of the present invention found out that by using magnesium silicate having specific characteristics as an external additive, microparticles of the external additive can be suitably attached by addition (external addition) on the surface of colored resin particles, and defects such as release and burial of the microparticles of the external additive are less likely to occur. In addition, damage of photosensitive members and filming can be prevented, thereby a stable charge property and flowability can be imparted to toner particles over time. Thus, deterioration of image quality due to fog, blur, white streaks or the like is hardly caused. Therefore, printing durability is excellent even if continuous printing of plural prints is performed. Based on the above knowledge, the inventor has reached the present invention.

Specifically, a positively-chargeable toner for developing electrostatic images of the present invention is a positively-chargeable toner for developing electrostatic images comprising colored resin particles containing a colorant and a binder resin, and an external additive, wherein the external additive contains magnesium silicate having negatively charging ability, with a Mohs hardness of 3 or less and a number average primary particle diameter in the range from 1 to 15 μm.

Advantageous Effects of Invention

According to the positively-chargeable toner for developing electrostatic images of the present invention, microparticles of an external additive can be suitably attached by addition (external addition) on the surface of colored resin particles. Thereby, damage of photosensitive members and filming due to the external additive can be prevented, and a stable charge property and flowability can be imparted to toner particles over time. Thus, a positively-chargeable toner for developing electrostatic images, which hardly causes deterioration of image quality due to fog, blur, white streaks or the like, and therefore is excellent in printing durability even if continuous printing of plural prints is performed, is provided.

DESCRIPTION OF EMBODIMENTS

A positively-chargeable toner for developing electrostatic images of the present invention is a positively-chargeable toner for developing electrostatic images comprising colored resin particles containing a colorant and a binder resin, and an external additive, wherein the external additive contains magnesium silicate having negatively charging ability, with a Mohs hardness of 3 or less and a number average primary particle diameter in the range from 1 to 15 μm.

Hereinafter, the positively-chargeable toner for developing electrostatic images (hereinafter, it may be simply referred to as "toner") of the present invention will be explained.

The toner of the present invention comprises colored resin particles containing a colorant and a binder resin, and an external additive. The colored resin particles preferably contain a charge control agent having positively charging ability and a release agent.

Specific examples of the binder resin include resins such as polystyrene, styrene-butyl acrylate copolymers, polyester resins and epoxy resins, which have been conventionally and widely used in toners.

In the present invention, examples of methods of producing the colored resin particles include (A) polymerization methods and (B) pulverization methods, but are not particularly limited. Toners obtained from the above methods are respectively referred to as a polymerized toner and a pulverized toner. As the toner of the present invention, the polymerized toner is preferable since the polymerized toner has relatively small particle size distribution in micron order. Examples of the polymerization methods include the emulsion polymerization the agglomeration method, the dispersion polymerization method, the suspension polymerization method and the like. The suspension polymerization method is preferable.

In the case of producing the colored resin particles by employing the polymerization method, the following processes are performed.

(A) Polymerization Method (1) Preparation Process of Polymerizable Monomer Composition Firstly, a polymerizable monomer, a colorant, if required, a charge control agent and other additives are mixed to prepare a polymerizable monomer composition. Mixing upon preparing the polymerizable monomer composition is performed by means of a media type dispersing machine.

In the present invention, the polymerizable monomer means a compound which can be polymerized. As a main component of the polymerizable monomer, a monovinyl monomer is preferably used. Examples of the monovinyl monomer include styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; amide compounds such as acrylamide and methacrylamide; and olefins such as ethylene, propylene and butylene. The monovinyl monomer may be used alone or in combination. Among the above, styrene, styrene derivatives, acrylic acid or methacrylic acid derivatives are suitably used as the monovinyl monomer.

In order to prevent hot offset, as a part of the polymerizable monomer, any crosslinkable polymerizable monomer may be preferably used together with the monovinyl monomer. The crosslinkable polymerizable monomer means a monomer having two or more polymerizable functional groups. Examples of the crosslinkable polymerizable monomer include aromatic divinyl compounds such as divinyl benzene, divinyl naphthalene and derivatives thereof; unsaturated carboxylic acid polyesters of polyalcohol such as ethylene glycol dimethacrylate and diethylene glycol dimethacrylate; divinyl compounds other than the above such as N,N-divinylaniline and divinyl ether; and compounds having three or more vinyl groups such as trimethylolpropane trimethacrylate and dimethylolpropane tetraacrylate. The crosslinkable polymerizable monomer may be used alone or in combination of two or more kinds.

In the present invention, it is desirable that the amount of the crosslinkable polymerizable monomer is generally from 0.1 to 5 parts by weight, preferably from 0.3 to 2 parts by weight, with respect to the monovinyl monomer of 100 parts by weight.

Further, as a part of the polymerizable monomer, any macromonomer may be preferably used together with the monovinyl monomer so that the shelf stability and low-temperature fixability of the toner can be well-balanced. The macromonomer is a reactive oligomer or polymer having a polymerizable carbon-carbon unsaturated double bond at the end of a polymer chain and generally a number average molecular weight of 1,000 to 30,000. As the macromonomer, a macromonomer which provides a polymer having higher "Tg" (glass transition temperature) than that of a polymer obtained by polymerization of the monovinyl monomer is preferable.

In the present invention, it is desirable that the amount of the macromonomer is generally in the range from 0.01 to 10 parts by weight, preferably from 0.03 to 5 parts by weight, more preferably from 0.05 to 1 part by weight, with respect to the monovinyl monomer of 100 parts by weight.

The colorant is used in the present invention. To produce a colored toner, in which four types of toners including a black toner, a cyan toner, a yellow toner and a magenta toner are generally used, a black colorant, a cyan colorant, a yellow colorant and a magenta colorant may be respectively used.

In the present invention, examples of the black colorant to be used include carbon black, titanium black, magnetic powder such as zinc-ferric oxide and nickel-ferric oxide.

Examples of the cyan colorant include compounds such as copper phthalocyanine pigments, derivatives thereof and anthraquinone pigments. The specific examples include C. I. Pigment Blue 2, 3, 6, 15, 15:1, 15:2, 15:3, 15:4, 16, 17:1 and 60. For a good stability in polymerization and tinting strength of the toner to be obtained, the copper phthalocyanine pigments such as C. I. Pigment Blue 15, 15:1, 15:2, 15:3, 15:4 and 17:1 are preferable, and C. I. Pigment Blue 15:3 is more preferable.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185 and 186.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209 and 251, and C. I. Pigment Violet 19. For a good stability in polymerization and tinting strength of the toner to be obtained, the monoazo pigments such as C. I. Pigment Red 31, 48, 57:1, 58, 60, 63, 64, 68, 112, 114, 146, 150, 163, 170, 185, 187, 206 and 207 are preferable.

In the present invention, the colorant may be used alone or in combination of two or more kinds. The amount of the colorant to be used is preferably in the range from 1 to 10 parts by weight with respect to the monovinyl monomer of 100 parts by weight.

As other additives, a charge control agent having positively charging ability is preferably used. The examples include charge control agents which are not resins such as metallic complexes of organic compounds having nitrogen-containing groups, metallized dyes and nigrosine; and charge control resins such as quaternary ammonium base-containing copolymers. Among the above, since the printing durability of the toner becomes excellent, the charge control agent containing any of the charge control resins is preferable. Among the charge control agents, any of the charge control agents which are not a resin and the charge control resin may be used together, or the charge control resin may be used alone. It is more preferable to use the charge control resin alone. It is further preferable to use any of the quaternary ammonium base-containing copolymers as the charge control resin.

In the present invention, it is desirable that the amount of the charge control agent is generally in the range from 0.01 to 10 parts by weight, preferably from 0.03 to 8 parts by weight, with respect to the monovinyl monomer of 100 parts by weight.

As one of other additives, the release agent is preferably added since the releasing characteristic of the toner from a fixing roller at fixing can be improved. As the release agent, one which is generally used as a release agent for the toner may be used without any particular limitation. The examples include polyolefin waxes such as low-molecular-weight polyethylene, low-molecular-weight polypropylene and low-molecular-weight polybutylene; natural waxes such as candelilla, carnauba waxes, rice waxes, haze waxes and jojoba; petroleum waxes such as paraffin, microcrystalline and petrolactam; mineral waxes such as montan, ceresin and ozokerite; synthesized waxes such as Fischer-Tropsch waxes; and esterified compounds of polyalcohol including pentaerythritol ester such as pentaerythritol tetramyristate, pentaerythritol tetrapalmitate, pentaerythritol tetrastearate and pentaerythritol tetralaurate, and dipentaerythritol ester such as dipentaerythritol hexamyristate, dipentaerythritol hexapalmitate and dipentaerythritol hexylaurate. Among the above, the esterified compounds of polyalcohol are preferable since the low-temperature fixability of the toner can be improved and the printing durability cannot be deteriorated. The release agents may be used alone or in combination of two or more kinds.

In the present invention, it is desirable that the amount of the release agent is generally in the range from 0.1 to 30 parts by weight, preferably from 1 to 20 parts by weight, with respect to the monovinyl monomer of 100 parts by weight.

As one of other additives, a molecular weight modifier is preferably used. Examples of the molecular weight modifier include mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N,'-diphenyl thiuram disulfide and N,N'-dioctadecyl-N,N'-diisopropyl thiuram disulfide. The molecular weight modifier may be added prior to or during polymerization.

In the present invention, it is desirable that the amount of the molecular weight modifier is generally in the range from 0.01 to 10 parts by weight, preferably from 0.1 to 5 parts by weight, with respect to the monovinyl monomer of 100 parts by weight.

(2) Suspension Process of Obtaining Suspension (Droplets Forming Process)

The polymerizable monomer composition obtained in "(1) Preparation process of polymerizable monomer composition" is suspended in an aqueous dispersion medium, thus, a suspension (polymerizable monomer composition dispersion liquid) is obtained. Herein, "suspension" means that droplets of the polymerizable monomer composition are formed in the aqueous dispersion medium. Dispersion treatment for forming the droplets may be performed by means of a device capable of strong stirring such as an in-line type emulsifying and dispersing machine (product name: EBARA MILDER; manufactured by Ebara Corporation), and a high-speed emulsification dispersing machine (product name: T. K. HOMOMIXER MARK II; manufactured by PRIMIX Corporation).

In the present invention, the aqueous dispersion medium may be water alone but any of water-soluble solvents such as lower alcohols and lower ketones may be used together.

A dispersion stabilizer is preferably contained in the aqueous dispersion medium. Examples of the dispersion stabilizer include metallic compounds including sulfates such as barium sulfate and calcium sulfate; carbonates such as barium carbonate, calcium carbonate and magnesium carbonate; phosphates such as calcium phosphate; metallic oxides such as aluminum oxide and titanium oxide; and metallic hydroxides such as aluminum hydroxide, magnesium hydroxide and ferric hydroxide; and organic compounds including water-soluble polymers such as polyvinyl alcohol, methyl cellulose and gelatin; anionic surfactants; nonionic surfactants; and ampholytic surfactants.

Among the dispersion stabilizers, any of the metallic compounds, particularly, a dispersion stabilizer containing colloid of hardly water-soluble metal hydroxide is preferable, since the particle distribution of the colored resin particles can be narrowed and the residual amount of the dispersion stabilizer after washing can be small, so that the polymerized toner to be obtained can reproduce clear image, particularly, image quality under the high humid and high temperature environment is less likely to deteriorate.

The dispersion stabilizer may be used alone or in combination of two or more kinds. The added amount of the dispersion stabilizer is preferably in the range from 0.1 to 20 parts by weight, more preferably from 0.2 to 10 parts by weight, with respect to the polymerizable monomer of 100 parts by weight. Also, with respect to the aqueous dispersion medium of 100 parts by weight, the added amount of the dispersion stabilizer is preferably in the range from 0.1 to 10 parts by weight, more preferably from 0.2 to 5 parts by weight.

Examples of a polymerization initiator include persulfates such as potassium persulfate and ammonium persulfate; azo compounds such as 4,4'-azobis(4-cyanovaleric acid), 2,2'-azobis(2-methyl-N-(2-hydroxyethyl)propionamide, 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylhexanoate, t-butylperoxypyvalate, diisopropylperoxydicarbonate, di-t-butylperoxyisophthalate and t-butylperoxyisobutyrate. Among the above, the organic peroxides are preferably used since the residue amount of the polymerizable monomer can be reduced and printing durability is excellent.

The polymerization initiator may be added after dispersing the polymerizable monomer composition to the aqueous dispersion medium and before forming droplets as described above, or may be added to the polymerizable monomer composition.

The added amount of the polymerization initiator used in polymerization of the polymerizable monomer composition is preferably in the range from 0.1 to 20 parts by weight, more preferably from 0.3 to 15 parts by weight, most preferably from 1.0 to 10 parts by weight, with respect to the monovinyl monomer of 100 parts by weight.

(3) Polymerization Process

The suspension (the aqueous dispersion medium containing droplets of the polymerizable monomer composition) obtained in "(2) Suspension process of obtaining a suspension (droplets forming process)" is heated to polymerize. Thereby, an aqueous dispersion liquid of colored resin particles can be obtained.

In the present invention, polymerization temperature is preferably 50° C. or more, more preferably in the range from 60 to 95° C. Polymerization reaction time is preferably in the range from 1 to 20 hours, more preferably from 2 to 15 hours.

In order to polymerize droplets of the polymerizable monomer composition in a stably dispersed state, the polymerization reaction may proceed while agitating the droplets for dispersion treatment in the polymerization process continuously after "(2) Suspension process of obtaining suspension (droplets forming process)".

In the present invention, it is preferable to form a so-called core-shell type (or "capsule type") colored resin particle, which can be obtained by using the colored resin particle obtained by the polymerization process as a core layer and forming a shell layer, a material of which is different from that of the core layer, around the core layer.

The core-shell type colored resin particles can take a balance of lowering of fixing temperature and prevention of blocking at storage of the toner by covering the core layer including a substance having a low-softening point with a substance having a high softening point.

A method for producing the core-shell type colored resin particles mentioned above may not be particularly limited, and may be produced by any conventional method. The in situ polymerization method and the phase separation method are preferable from the viewpoint of production efficiency.

A method of producing the core-shell type colored resin particles according to the in situ polymerization method will be hereinafter described.

A polymerizable monomer (a polymerizable monomer for shell) for forming a shell layer and a polymerization initiator for shell are added to an aqueous dispersion medium to which the colored resin particles are dispersed followed by polymerization, thus the core-shell type colored resin particles can be obtained.

As the polymerizable monomer for shell, the above described polymerizable monomers can be similarly used. Among the above, any of monomers which provide a polymer having "Tg" of more than 80° C. such as styrene and methyl methacrylate may be preferably used alone or in combination of two or more kinds.

Examples of the polymerization initiator for shell used for polymerization of the polymerizable monomer for shell include polymerization initiators including metal persulfates such as potassium persulfate and ammonium persulfate; and water-soluble azo compounds such as 2,2'-azobis-(2-methyl-N-(2-hydroxyethyl) propionamide) and 2,2'-azobis-(2-methyl-N-(1,1-bis(hydroxymethyl) 2-hydroxy ethyl) propionamide).

In the present invention, the added amount of the polymerization initiator for shell is preferably in the range from 0.1 to 30 parts by weight, more preferably from 1 to 20 parts by weight, with respect to the polymerizable monomer for shell of 100 parts by weight.

The polymerization temperature of the shell layer is preferably 50° C. or more, more preferably in the range from 60 to 95° C. Also, the polymerization time of the shell layer is preferably in the range from 1 to 20 hours, more preferably from 2 to 15 hours.

(4) Processes of Washing, Filtering, Dehydrating and Drying

It is preferable that the aqueous dispersion liquid of the colored resin particles obtained after "(3) polymerization process" is subjected to a series of operations including washing, filtering, dehydrating, and drying several times as needed according to any conventional method.

Firstly, in order to remove the dispersion stabilizer remained in the aqueous dispersion liquid of the colored resin particles, acid or alkali is added to the aqueous dispersion liquid of the colored resin particles to wash.

If the dispersion stabilizer being used is an acid-soluble inorganic compound, acid is added to the aqueous dispersion liquid of the colored resin particles. On the other hand, if the dispersion stabilizer being used is an alkali-soluble inorganic compound, alkali is added to the aqueous dispersion liquid of the colored resin particles.

If the acid-soluble inorganic compound is used as the dispersion stabilizer, it is preferable to control pH of the aqueous dispersion liquid of the colored resin particles to 6.5 or less by adding acid. It is more preferable to control pH to 6 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

After the above acid or alkali washing, washing treatment (washing, filtering and dehydrating) is performed using cleaning water such as ion-exchange water followed by drying treatment.

As a method of the washing treatment, any of various known methods can be used and is not particularly limited. Examples of the various methods include the centrifugal filtration, the pressure filtration and the vacuum filtration. Examples of washing devices for the washing treatment (washing, filtering and dehydrating) include a peeler centrifuge and a siphon peeler centrifuge.

As a method of the drying treatment, any of various known methods can be used and is not particularly limited. Examples of the various methods to be used for the drying treatment include the vacuum drying, the flash drying and drying with a spray dryer.

(B) Pulverization Method

In the case of producing the colored resin particles by employing the pulverization method, the following processes are performed.

Firstly, a colorant, a binder resin, if required, a charge control agent and other additives are mixed by means of a mixer such as a ball mill, a V type mixer, Henschel Mixer (product name), a high-speed dissolver and an internal mixer. Next, the mixture obtained is kneaded while heating by means of a press kneader, a twin screw kneading machine or a roller. The obtained kneaded product is crushed by means of a pulverizer such as a hammer mill, a cutter mill or a roller mill, followed by finely pulverizing by means of a pulverizer such as a jet mill or a high-speed rotary pulverizer, and classifying into the desired particle diameters by means of a classifier such as a wind classifier or an airflow classifier. Thus, the colored resin particles produced by the pulverization method can be obtained.

The colorant, the binder resin, the charge control agent and other additives used in (A) polymerization method can be used in the pulverization method. Similarly as the colored resin particles obtained by (A) polymerization method, the colored resin particles obtained by the pulverization method can also be in a form of the core-shell type colored resin particles produced by a method such as the in situ polymerization method.

(5) Colored Resin Particle

The colored resin particles can be obtained by (A) polymerization method or (B) pulverization method.

The colored resin particles constituting the toner will be hereinafter described. Hereinafter, the colored resin particles include both core-shell type colored resin particles and colored resin particles which are not core-shell type.

The volume average particle diameter "Dv" of the colored resin particles of the present invention is preferably in the range from 3 to 15 μm, more preferably from 4 to 12 μm, even more preferably from 5 to 10 μm, from the viewpoint of image reproducibility.

If "Dv" of the colored resin particles of the present invention is less than the above range, the flowability of the toner lowers and deterioration of image quality due to fog or the like tends to occur. On the other hand, if "Dv" exceeds the above range, the resolution of images to be obtained may decrease.

As for the colored resin particles in the present invention, a particle size distribution (Dv/Dn), which is the ratio of a volume average particle diameter "Dv" and a number average particle size "Dn", is preferably in the range from 1.0 to 1.3, more preferably from 1.0 to 1.2, from the viewpoint of image reproducibility.

If the particle size distribution (Dv/Dn) of the colored resin particles of the present invention exceeds the above range, the flowability of the toner lowers and deterioration of image quality due to fog or the like tends to occur.

"Dv" and "Dn" of the colored resin particles may be measured, for example, by means of a particle diameter measuring device (product name: MULTISIZER; manufactured by Beckman Coulter, Inc.) or the like.

The average circularity of the colored resin particles in the present invention is preferably in the range from 0.960 to 0.995, more preferably from 0.970 to 0.995, from the viewpoint of image reproducibility.

In the present invention, circularity is a value obtained by dividing a perimeter of a circle having an area same as a projected area of a particle by a perimeter of a particle image. Also, in the present invention, an average circularity is used as a simple method of quantitatively presenting shapes of particles and is an indicator showing the level of convexo-concave shapes of the colored resin particle. The average circularity is "1" when the colored resin particle is an absolute sphere, and becomes smaller as the shape of the surface of the colored resin particle becomes more complex. In order to obtain the average circularity (Ca), firstly, the circularity (Ci) of each of measured "n" particles of 0.6 μm or more by the diameter of an equivalent circle is calculated by the following Calculation formula 1. Next, the average circularity (Ca) is obtained by the following Calculation formula 2.

Circularity (Ci)=a perimeter of a circle having an area same as a projected area of a particle/a perimeter of a particle image — Calculation formula 1

Calculation formula 2

$$Ca = \frac{\sum_{i=1}^{n} (Ci \times fi)}{\sum_{i=1}^{n} (fi)}$$

In Calculation formula 2, "fi" is the frequency of particles of circularity (Ci).

The above circularity and average circularity may be measured by means of any of flow particle image analyzers FPIA-2000, FPIA-2100, FPIA-3000 (product name; manufactured by Sysmex Co.) or the like.

If the average circularity of the colored resin particles exceeds the above range, the colored resin particles can easily pass through between a cleaning blade and a photosensitive member so that cleaning problems such as filming on the photosensitive member or fog of printed images tend to occur. If the average circularity of the colored resin particles is less than the above range, the reproductivity of thin lines may decrease.

(6) External Addition Process

The colored resin particles obtained in (A) polymerization method or (B) pulverization method are mixed and agitated together with the external additive specified in the present invention. Thereby, the microparticles of the external additive can be suitably attached by addition on the surface of the colored resin particles.

A method for attaching or externally adding the external additive specified in the present invention on the surface of the colored resin particles is not particularly limited. The method may be performed using a device capable of mixing and agitating including, for example, high speed agitators such as Henschel Mixer (product name, manufactured by NIPPON COKE & ENGINEERING CO., LTD.), SUPER MIXER (product name, manufactured by KAWATA MFG Co., Ltd.), Q MIXER (product name, manufactured by NIPPON COKE & ENGINEERING CO., LTD.), Mechanofusion system (product name, manufactured by Hosokawa Micron Corporation) and MECHANOMILL (product name, manufactured by OKADA SEIKO CO., LTD.).

The external additive specified in the present invention is magnesium silicate having negatively charging ability.

Magnesium silicate used as the external additive in the present invention is any of composite oxides having two main components of $SiO_2$ and MgO bonded in various amounts. As for the ratio of $SiO_2$ and MgO, which are main components of magnesium silicate, it is preferable that $SiO_2$ is contained at a higher ratio than MgO. Further, it is more preferable that $SiO_2$ is contained at a ratio 1.2 to 3 times higher than MgO.

Specific examples of magnesium silicate include talc ($3MgO.4SiO_2.H_2O$; Mohs hardness: 1), forsterite ($2MgO.SiO_2$; Mohs hardness: 7), steatite ($MgO.SiO_2$; Mohs hardness: 6) and enstatite ($MgO.SiO_2$; Mohs hardness: 5.5). Among the above, it is particularly preferable to use talc which is magnesium silicate having negatively charging ability with a Mohs hardness of 3 or less in the present invention since the effect of preventing damage of photosensitive members and filming due to the external additive is high.

Talc is powder having a high degree of whiteness made of finely pulverized ore of talc, and is magnesium silicate containing water ($3MgO.4SiO_2.H_2O$) including two main components of $SiO_2$ (about 60%) and MgO (about 30%) and further crystal water (4.8%).

In addition, since talc has characteristics such as softness and smoothness, and has a plate-like shape, the microparticles of the external additive can be suitably attached by addition on the surface of the colored resin particles, the effect of keeping the attached state is high, and defects such as release and burial of the microparticles of the external additive are less likely to occur. Thereby, stable charge property and flowability can be imparted to the toner particles over time.

For talc preferably used as the external additive in the present invention, various types of commercial products can be used. Examples of commercial products manufactured by TAKEHARA KAGAKU KOGYO Co., Ltd. include P talc (number average primary particle diameter: 9 μm), PH talc (number average primary particle diameter: 6 μm), PS talc (number average primary particle diameter: 9 μm), TTK talc (number average primary particle diameter: 9 μm), TT talc (number average primary particle diameter: 7 μm), T talc (number average primary particle diameter: 9 μm), ST talc (number average primary particle diameter: 9 μm), High toron (number average primary particle diameter: 4 μm), High toron A (number average primary particle diameter: 3 μm), Microlight (number average primary particle diameter: 2.5 μm), Hi-lac (number average primary particle diameter: 7 μm) and High micron HE5 (number average primary particle diameter: 1.6 μm).

The Mohs hardness of the magnesium silicate used as the external additive in the present invention is 3 or less, preferably 2 or less, and more preferably in the range from 0.5 to 1.2.

If the Mohs hardness of the magnesium silicate is within the above range, the hardness of the external additive becomes appropriate, and defects such as release and burial of the microparticles of the external additive are less likely to occur. In addition, damage of photosensitive members and filming can be prevented, thereby a stable charge property and flowability can be imparted to the toner particles over time. Thus, deterioration of image quality is hardly caused on printing. Therefore, printing durability is excellent.

In addition, if the Mohs hardness of the magnesium silicate exceeds the above range, it becomes difficult to prevent damage of photosensitive members. Thus, deterioration of image quality due to fog, blur, white streaks or the like tends to occur on printing. Therefore, printing durability may be inferior.

Herein, "Mohs hardness" means an indicator invented by F. Mohs in 1822, wherein talc is defined as 1 and diamond is defined as 10 as standard substances; further, other standard substances as typical mineral substances between talc 1 (soft) and diamond 10 (hard) are selected; and the hardness of each of the standard substances and the hardness of an object substance are compared to relatively evaluate the hardness of the object substance. Selected standard substances are 1: talc; 2: gypsum; 3: calcite; 4: fluorite; 5: apatite; 6: orthoclase; 7: crystal; 8: topaz; 9: corumdum; and 10: diamond in order of low hardness.

The evaluation of "Mohs hardness" is performed by scratching the object substance sequentially using ten kinds of standard substances selected as above, and observing whether the object substance gets scratched or not. If the object substance gets scratched, it is evaluated that the hardness of the object substance is lower (soft) than that of the standard substance being used.

The number average primary particle diameter of the magnesium silicate used as the external additive in the present invention is in the range from 1 to 15 μm, preferably from 1 to 10 μm, and more preferably from 2 to 10 μm.

If the number average primary particle diameter of the magnesium silicate is in the above range, defects such as release and burial of the microparticles of the external additive are less likely to occur. In addition, damage of photosensitive members and filming can be prevented, thereby a stable charge property and flowability can be imparted to the toner particles over time. Thus, deterioration of image quality is hardly caused on printing. Therefore, printing durability is excellent.

In addition, if the number average primary particle diameter of the magnesium silicate is less than the above range, flowability lowers and it becomes difficult to prevent filming. Thus, deterioration of image quality due to fog, blur, white streaks or the like tends to occur on printing and printing durability may be inferior. On the other hand, if the number average primary particle diameter of the magnesium silicate exceeds the above range, it becomes difficult to keep a stable charge property over time. Thus, deterioration of image quality due to fog, blur, white streaks or the like tends to occur on printing and printing durability may be inferior.

The content of the magnesium silicate used as the external additive in the present invention is preferably in the range from 0.05 to 1 part by weight, more preferably from 0.1 to 0.5 parts by weight, and still more preferably from 0.1 to 0.35 parts by weight, with respect to 100 parts by weight of the colored resin particles.

If the content of the magnesium silicate is in the above range, defects such as release and burial of the microparticles of the external additive are less likely to occur. In addition, damage of photosensitive members and filming can be prevented, thereby a stable charge property and flowability can be imparted to the toner particles over time. Thus, deterioration of image quality is hardly caused on printing. Therefore, printing durability is excellent.

Also, if the content of the magnesium silicate is less than the above range, desired functions as the external additive are hardly obtained and it becomes difficult to prevent filming. Thus, deterioration of image quality due to fog, blur, white streaks or the like tends to occur on printing and printing durability may be inferior. On the other hand, if the content of the magnesium silicate exceeds the above range, flowability lowers, thereby, it becomes difficult to prevent damage of photosensitive members and filming. Thus, deterioration of image quality due to fog, blur, white streaks or the like tends to occur on printing. Therefore, printing durability may be inferior.

The magnesium silicate used as the external additive in the present invention may be subjected to hydrophobicity-imparting treatment. Examples of a hydrophobicity-imparting treatment agent to be used include silane coupling agents, silicone oils, fatty acids and metal salts of fatty acids. Among the above, silane coupling agents and silicone oils are preferable.

Examples of the silane coupling agents include disilazanes such as hexamethyldisilazane; cyclic silazanes; alkylsilane compounds such as trimethylsilane, trimethylchlorosilane, dimethyldichlorosilane, methyltrichlorosilane, allyldimethylchlorosilane, benzyl dimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane and vinyltriacetoxysilane; and aminosilane compounds such as γ-aminopropyltriethoxysilane, γ-(2-aminoethyl)aminopropyltrimethoxysilane, γ-(2-aminoethyl) aminopropylmethyldimethoxysilane, N-phenyl-3-aminopropyltrimethoxysilane, N-(2-aminoethyl)-3-aminopropyltrimethoxysilane, and N-β-(N-vinylbenzylaminoethyl)-γ-aminopropyltrimethoxysilane. Examples of the silicone oils include dimethylpolysiloxane, methylhydrogenpolysiloxane, methylphenylpolysiloxane and amino modified silicone oils. The hydrophobicity-imparting treatment agent may contain one or more kinds of the above agents. It is more preferable to use any of the silicone oils or silane coupling agents since the toner to be obtained can provide high image quality.

As a method of the hydrophobicity-imparting treatment of the magnesium silicate used as the external additive in the present invention, any of general methods such as a dry method and a wet method may be used.

The specific examples include a method in which the above described hydrophobicity-imparting treatment agent is added dropwise or sprayed while agitating magnesium silicate used as the external additive at high speed, and a method in which the above described hydrophobicity-imparting treatment agent is dissolved in an organic solvent and magnesium silicate is added while agitating the organic solvent containing the hydrophobicity-imparting treatment agent.

In the present invention, silica particles (A) and silica particles (B) having the number average primary particle diameter specified below are preferably used together besides the aforementioned external additive (magnesium silicate).

The number average primary particle diameter of the silica particles (A) is preferably in the range from 5 to 20 nm, more preferably from 5 to 17 nm, still more preferably from 6 to 13 nm.

The number average primary particle diameter of the silica particles (B) is preferably in the range from 25 to 70 nm, more preferably from 25 to 60 nm, still more preferably from 30 to 55 nm.

In the present invention, in the case that the external additives (silica particles (A) and silica particles (B)) having different particle diameter are used together besides the aforementioned external additive (magnesium silicate), external addition may be performed by charging the colored resin particles and all kinds of external additives may be charged in a high-speed agitator and the external additives may be externally added. It is preferable that only the colored resin particles and the external additive having a large particle diameter are first charged in a high-speed agitator and the external additive is externally added, and then, the external additives having smaller particle diameters are further charged and the external additives are externally added.

In the present invention, the content of silica particles (A) preferably used together besides the aforementioned external additive (magnesium silicate) is preferably in the range from 0.3 to 2 parts by weight, more preferably from 0.4 to 1.5 parts by weight, and still more preferably from 0.4 to 1.2 parts by weight, with respect to 100 parts by weight of the colored resin particles.

In addition, the content of silica particle (B) preferably used together besides the aforementioned external additive (magnesium silicate) is preferably in the range from 0.5 to 3 parts by weight, more preferably from 0.7 to 2.5 parts by weight, and still more preferably from 0.8 to 2.0 parts by weight, with respect to 100 parts by weight of the colored resin particles.

Both silica particles (A) and silica particles (B) are preferably subjected to hydrophobicity-imparting treatment. A hydrophobicity-imparting treatment agent and a method of the hydrophobicity-imparting treatment may be the same as the aforementioned external additive (magnesium silicate).

(7) Toner

The toner obtained as a result of the processes (1) to (6) uses the magnesium silicate having specific characteristics as the external additive, thereby, the microparticles of the external additive can be suitably attached (externally added) to the surface of the colored resin particles, and the suitable attached state of the external additive can be maintained over time. Thus, defects such as release and burial of the microparticles of the external additive are less likely to occur. In addition, damage of photosensitive members and filming can be prevented.

Also, the toner obtained as a result of the processes (1) to (6) can impart a stable charge property and flowability over time to the toner particles, and thus, hardly causes deterioration of image quality due to fog, blur, white streaks or the like. Therefore, the toner is excellent in printing durability even if continuous printing of plural prints is performed.

EXAMPLES

Hereinafter, the present invention will be explained further in detail with reference to examples and comparative examples. However, the scope of the present invention may not be limited to the following examples. Herein, "part(s)" and "%" are based on weight if not particularly mentioned.

Test methods used in the examples and the comparative examples are as follows.

(1) Number Average Primary Particle Diameter of External Additive

The number average primary particle diameter of an external additive was determined by: taking an electron micrograph of particles of the external additive; and calculating the arithmetic mean value of diameters of the equivalent circles corresponding to projected areas of the particles in the electron micrograph under the condition that the area ratio of particles to a frame area is up to 2% and the total number of analyzed particles is 100, by means of an image analyzing system (product name: LUZEX IID; manufactured by NIRECO CORPORATION).

(2) Characteristics of Colored Resin Particles (2-1) Volume Average Particle Diameter "Dv", Number Average Particle Diameter "Dn" and Particle Size Distribution "Dv/Dn"

About 0.1 g of a test sample (colored resin particles) was weighed and charged into a beaker. Then, an aqueous solution of alkyl benzene sulfonate (product name: DRIWEL; manufactured by FUJIFILM Corporation) of 0.1 ml was added therein as a dispersant. Further, from 10 to 30 ml of ISOTON II was added to the beaker. The mixture was dispersed by means of an ultrasonic disperser at 20 watts for three minutes. Then, the volume average particle diameter "Dv" and the number average particle diameter "Dn" of the colored resin particles were measured by means of a particle diameter measuring device (product name: MULTISIZER; manufactured by: Beckman Coulter, Inc.) under the condition of an aperture diameter of 100 μm, using ISOTON II as a medium, and a number of the measured particles of 100,000. Therefrom, the particle size distribution (Dv/Dn) was calculated.

(2-2) Average Circularity

Into a container pre-filled with ion-exchanged water of 10 ml, a surfactant (alkyl benzene sulfonate) of 0.02 g as a dispersant and colored resin particles of 0.02 g were charged. Then, dispersion treatment was performed by means of an ultrasonic disperser at 60 watts for three minutes. The density of colored resin particles during measurement was adjusted to be 3,000 to 10,000 particles/μL, and 1,000 to 10,000 colored resin particles having a diameter of 0.4 μm or more by a diameter of the equivalent circle were subjected to measurement by means of a flow particle image analyzer (product name: FPIA-2100; manufactured by: Sysmex Co.). The average circularity was calculated from measured values thus obtained.

Circularity can be calculated by the following Calculation formula 1, and the average circularity is an average of calculated circularities:

Circularity=a perimeter of a circle having an area same as a projected area of a particle/a perimeter of a projected image of a particle — Calculation formula 1

(3) Flowability

Three kinds of sieves respectively having a width of opening of 150 μm, 75 μm and 45 μm were layered in this order and a sample (toner) of 4 g was weighted and put onto the layered sieves. Next, three kinds of layered sieves were vibrated by means of a powder characteristics measuring device (product name: POWDER TESTER PT-S; manufactured by: Hosokawa Micron Corporation) at an amplitude of 0.4 mm for 15 seconds, and then, the weight of toner remained on each sieve was measured. The value of flowability was calculated by the following calculation formulas 3 and 4. Measurement was performed three times on one sample, and the average value of the measured values was calculated.

Calculation formula 3

$$a = \frac{\text{the weight of a toner remained on the sieve having a width of opening of 150 μm (g)}}{4\ (\text{g})} \times 100$$

$$b = \frac{\text{the weight of a toner remained on the sieve having a width of opening of 75 μm (g)}}{4\ (\text{g})} \times 100 \times 0.6$$

$$c = \frac{\text{the weight of a toner remained on the sieve having a width of opening of 45 μm (g)}}{4\ (\text{g})} \times 100 \times 0.2$$

Flowability (%)=100−(a+b+c) — Calculation formula 4

(4) Printing Test (4-1) Fog

A commercially available printer of the non-magnetic one-component developing method (printing speed: 20 prints in A4 size per minute) was charged with printing papers and inserted with a cartridge charged with a toner. After the printer was left under the N/N (normal temperature and humidity) environment having a temperature of 23° C. and a humidity of 50% for one day, printing test with 1% image density was performed under the N/N environment to measure a fog value every 500 prints.

The number of sheets having a fog value of 1 or more (the number of sheets having fog generation) was counted and the printing test was performed up to 10,000 sheets, but when fog is generated in mid-course, the printing test (fog) was stopped at the time.

The fog value was measured as follows.

After a solid patterned image with 0% image density was printed every 500 prints with the printer followed by stopping solid pattern printing in mid-course, the toner remained in a non-image area on the photosensitive member after development was attached to an adhesive tape (product name: SCOTCH MENDING TAPE 810-3-18; manufactured by: Sumitomo 3M Limited). The tape was attached to a new printing paper, and the whiteness (B) of the printing paper with the tape was measured by means of a whiteness colorimeter (product name: SE-2000, manufactured by: NIPPON DENSHOKU INDUSTRIES CO., LTD.). An unused tape was attached to a printing paper so as to measure the whiteness (A) in the same manner. The difference of whiteness (B-A) is called a fog value. As the fog value decreases, less fog is produced and image quality is excellent.

In Table 1, the number of sheets having fog generation of "10,000<" means that fog did not generate at the time of 10,000 sheets.

(4-2) Blur

A commercially available printer of the non-magnetic one-component developing method (printing speed: 20 prints in A4 size per minute) was charged with printing papers and inserted with a cartridge charged with a toner. After the printer was left under the N/N (normal temperature and humidity) environment having a temperature of 23° C. and a humidity of 50% for one day, printing test with 1% image density was performed under the N/N environment. A solid patterned image with 100% image density was printed every 500 prints and generation of blur was confirmed. The number of sheets when the blur was firstly confirmed on the solid patterned image (the number of sheets having blur generation) was counted and the printing test was performed up to 10,000 sheets.

The printing test was not stopped when a white vertical streak was confirmed on the solid patterned image, but was stopped at the time of generation of fog. In Table 1, the number of sheets having a white streak of "not generated" means that both white streaks and fog did not generate at the time of 10,000 sheets.

(4-3) Filming

A commercially available printer of the non-magnetic one-component developing method (printing speed: 20 prints in A4 size per minute) was charged with printing papers and inserted with a cartridge charged with a toner. After the printer was left under the N/N (normal temperature and humidity) environment having a temperature of 23° C. and a humidity of 50% for one day, printing test with 1% image density was performed under the N/N environment. A halftone patterned image with 50% image density was printed every 500 prints and generation of whitely fuzzy filming was confirmed. The number of sheets when the whitely fuzzy filming was firstly confirmed on the halftone patterned image (the number of sheets having filming generation) was counted and the printing test was performed up to 10,000 sheets.

The printing test was not stopped when whitely fuzzy filming was confirmed on the halftone patterned image, but was stopped at the time of generation of fog. In Table 1, the number of sheets having filming generation of "10,000<" means that both white streaks and fog did not generate at the time of 10,000 sheets.

(4-4) White Streaks

A commercially available printer of the non-magnetic one-component developing method (printing speed: 20 prints in A4 size per minute) was charged with printing papers and inserted with a cartridge charged with a toner. After the printer was left under the N/N (normal temperature and humidity) environment having a temperature of 23° C. and a humidity of 50 for one day, printing test with 1% image density was performed under the N/N environment. A solid patterned image with 100% image density was printed every 500 prints and generation of white streak was confirmed. The number of sheets when the white streak was firstly confirmed on the solid patterned image (the number of sheets having generation of white streaks) was counted and the printing test was performed up to 10,000 sheets.

The printing test was not without stopped when a white vertical streak was confirmed on the solid patterned image, but was stopped at the time of generation of fog. In Table 1, the number of sheets having white streaks of "not generated" means that both white streaks and fog did not generate at the time of 10,000 sheets.

(5) Damage of Photosensitive Members

The photosensitive member was visually observed at the time of generation of fog, and damage of the photosensitive member was evaluated as follows:

the photosensitive member has no damage if the size of observed damage is less than 0.5 mm; and the photosensitive member has damage if the size of observed damage is more than 0.5 mm.

Example 1

83 parts of styrene and 17 parts of n-butyl acrylate as monovinyl monomers (calculated Tg of copolymer to be obtained=60° C.), 7 parts of carbon black (product name: #25B; manufactured by Mitsubishi Chemical Corporation) as a black colorant, 1 parts of charge control agent having positively charging ability (product name: FCA-207P; manufactured by Fujikura Kasei Co., Ltd.; a styrene/acrylate resin), 0.6 parts of divinylbenzene as a crosslinkable monomer, 1.9 parts of t-dodecyl mercaptan as a molecular weight modifier and 0.25 parts of polymethacrylic acid ester macromonomer (product name: AA6; manufactured by Toagosei Co., Ltd.) as a macromonomer were agitated by means of an agitator to mix followed by uniform dispersion by a media type dispersing machine. Thereto, 5 parts of dipentaerythritol hexamyristate as a release agent was added, mixed and dissolved. Thus, a polymerizable monomer composition was obtained.

Separately, an aqueous solution of 6.2 parts of sodium hydroxide (alkali hydroxide metal) dissolved in 50 parts of ion-exchanged water was gradually added to an aqueous solution of 10.2 parts of magnesium chloride (water-soluble polyvalent metallic salt) dissolved in 250 parts of ion-exchanged water at room temperature while agitating to prepare a magnesium hydroxide colloid (hardly water-soluble metal hydroxide colloid) dispersion liquid.

The polymerizable monomer composition was charged into the magnesium hydroxide colloid dispersion liquid thus obtained and agitated at room temperature until droplets are stable. Then, 6 parts of t-butylperoxy-2-ethylhexanoate (product name: PERBUTYL 0; manufactured by NOF Corporation) as a polymerization initiator was added therein. The mixture was subjected to a high shear agitation at 15,000 rpm for 10 minutes by means of an in-line type emulsifying and dispersing machine (product name: EBARA MILDER; manufactured by Ebara Corporation) to form droplets of the polymerizable monomer composition.

The thus obtained suspension having droplets of the polymerization monomer composition dispersed (a polymerizable monomer composition dispersion liquid) was charged into a reactor furnished with a stirring vane and the temperature thereof was raised to 90° C. to start a polymerization reaction. When the polymerization conversion rate reached almost 100%, a dispersion obtained by mixing 1 parts of methyl methacrylate (a polymerizable monomer for shell) and 10 parts of ion-exchanged water, and 0.3 parts of 2,2'-azobis (2-methyl-N-(2-hydroxyethyl)-propionamide) (product name: VA-086; manufactured by Wako Pure Chemical Industries, Ltd.; a polymerization initiator for shell) dissolved in 20 parts of ion-exchanged water were added in the reactor. After continuing the polymerization for 4 hours at 90° C., the reactor was cooled to room temperature to obtain an aqueous dispersion of colored resin particles.

The aqueous dispersion of colored resin particles obtained was subjected to acid washing in which sulfuric acid was added to be pH of 6.5 or less. After dehydrating by filtration, the aqueous dispersion of colored resin particles was subjected to water washing in which another 500 parts of ion-exchanged water was added to make a slurry again. After repeating a series of dehydration and water washing several times, the colored resin particles were dehydrated by filtration and charged into a container of a dryer for drying at 45° C. for 48 hours. Thus, dried colored resin particles were obtained.

The volume average particle diameter "Dv" of the colored resin particles obtained was 9.7 μm, and the particle size distribution "Dv/Dn" was 1.14. The average circularity was 0.983.

To the colored resin particles thus obtained of 100 parts, 0.25 parts of magnesium silicate, which is talc (product name: PH talc; manufactured by Takehara Kagaku Kogyo Co., Ltd.; $3MgO.4SiO_2.H_2O$; Mohs hardness: 1; number average primary particle diameter: 6 μm) as an external additive, 0.9 parts of silica particles (A) subjected to hydrophobicity-imparting treatment (product name: HDK2150; manufactured by Clariant; number average primary particle diameter: 12 nm) and 1.3 parts of silica particles (B) subjected to hydrophobicity-imparting treatment (product name: NA50Y; manufactured by Nippon Aerosil Co., Ltd.; number average primary particle diameter: 40 nm) as other external additives were added and mixed by means of a high speed agitator (product name: Henschel Mixer; manufactured by NIPPON COKE & ENGINEERING CO., LTD.) at a peripheral speed of 30 m/s for 6 minutes, and the external additives were externally added. Thus, a non-magnetic one-component positively-chargeable toner for developing electrostatic images of Example 1 was produced, and used for testing.

Example 2

A toner of Example 2 was produced similarly as Example 1 except that the kind of magnesium silicate used as the external additive was changed to talc (product name: Microlight; manufactured by Takehara Kagaku Kogyo Co., Ltd.; $3MgO.4SiO_2.H_2O$; Mohs hardness: 1; number average primary particle diameter: 2.5 μm), and was used for testing.

Example 3

A toner of Example 3 was produced similarly as Example 1 except that the kind of magnesium silicate used as the external additive was changed to talc (product name: TT talc; manufactured by Takehara Kagaku Kogyo Co., Ltd.; $3MgO.4SiO_2.H_2O$; Mohs hardness: 1; number average primary particle diameter: 7 μm), and the added amount of magnesium silicate was changed to 0.23 parts, and was used for testing.

Example 4

A toner of Example 4 was produced similarly as Example 1 except that the added amount of silica particles (A) used as the external additive was changed to 0.25 parts, and was used for testing.

Comparative Example 1

A toner of Comparative example 1 was produced similarly as Example 1 except that magnesium silicate used as the external additive was not added, and was used for testing.

Comparative Example 2

A toner of Comparative example 2 was produced similarly as Example 1 except that the kind of magnesium silicate used as the external additive was changed to forsterite ($2MgO.SiO_2$; Mohs hardness: 7; number average primary particle diameter: 3 μm), and the added amount of magnesium silicate was changed to 0.2 parts, and was used for testing.

Comparative Example 3

A toner of Comparative example 3 was produced similarly as Example 1 except that the kind of magnesium silicate used as the external additive was changed to talc ($3MgO.4SiO_2.H_2O$; Mohs hardness: 1; number average primary particle diameter: 48 μm), and the added amount of magnesium silicate was changed to 0.05 parts, and was used for testing.

(Results)

The test results of Examples and Comparative examples are shown in Table 1.

TABLE 1

| | | | Example 1 | Example 2 | Example 3 | Example 4 |
|---|---|---|---|---|---|---|
| External additives | Magnesium silicate | Type (product name) | Talc (PH talc) | Talc (Microlight) | Talc (TT talc) | Talc (PH talc) |
| | | Charge property | negative | negative | negative | negative |
| | | Mohs hardness | 1 | 1 | 1 | 1 |
| | | Number average primary particle diameter (μm) | 6 | 2.5 | 7 | 6 |
| | | Added amount (part) | 0.25 | 0.25 | 0.23 | 0.25 |
| | Silica particles (A) | Number average primary particle diameter (nm) | 12 | same as on the left | same as on the left | same as on the left |
| | | Added amount (parts) | 0.9 | 0.9 | 0.9 | 0.25 |
| | Silica particles (B) | Number average primary particle diameter (nm) | 40 | same as on the left | same as on the left | same as on the left |
| | | Added amount (parts) | 1.3 | same as on the left | same as on the left | same as on the left |
| Average circularity of colored resin particles | | | 0.983 | same as on the left | same as on the left | same as on the left |
| Flowability of toner (%) | | | 80 | 78 | 81 | 65 |
| Evaluation of image quality | Fog (sheets) | | 10,000< | 10,000< | 10,000< | 8,000 |
| | Blur (sheets) | | not generated | not generated | not generated | not generated |
| | Filming (sheets) | | 10,000< | 10,000< | 10,000< | 9,000 |
| | White streaks (sheets) | | not generated | not generated | not generated | not generated |
| Damage of photosensitive members | | | no | no | no | no |

| | | | Comparative example 1 | Comparative example 2 | Comparative example 3 |
|---|---|---|---|---|---|
| External additives | Magnesium silicate | Type (product name) | — | Forsterite | Talc |
| | | Charge property | — | negative | negative |
| | | Mohs hardness | — | 7 | 1 |
| | | Number average primary particle diameter (μm) | — | 3 | 48 |
| | | Added amount (part) | — | 0.2 | 0.05 |
| | Silica particles (A) | Number average primary particle diameter (nm) | same as on the left | same as on the left | same as on the left |
| | | Added amount (parts) | 0.9 | 0.9 | 0.9 |
| | Silica particles (B) | Number average primary particle diameter (nm) | same as on the left | same as on the left | same as on the left |

TABLE 1-continued

| | | | | |
|---|---|---|---|---|
| | Added amount (parts) | same as on the left | same as on the left | same as on the left |
| Average circularity of colored resin particles | | same as on the left | same as on the left | same as on the left |
| Flowability of toner (%) | | 85 | 55 | 55 |
| Evaluation of image quality | Fog (sheets) | 7,000 | 5,500 | 7,000 |
| | Blur (sheets) | not generated | 5,000 | not generated |
| | Filming (sheets) | 6,000 | 4,500 | 6,000 |
| | White streaks (sheets) | not generated | not generated | 3,000 |
| Damage of photosensitive members | | no | damaged | no |

(Summary of Results)

The following can be found from the test results shown in Table 1.

The toner of Comparative example 1 could not prevent filming, easily caused deterioration of image quality, and was inferior in printing durability, since the toner of Comparative example 1 did not use the magnesium silicate specified in the present invention as the external additive.

The toner of Comparative example 2 could not prevent damage of the photosensitive member and filming, easily caused deterioration of image quality, and was inferior in printing durability, since the toner of Comparative example 2 used the magnesium silicate which exceeded the range of Mohs hardness specified in the present invention as the external additive.

The toner of Comparative example 3 could not prevent filming, easily caused deterioration of image quality, and was inferior in printing durability, since the toner of Comparative example 3 used the magnesium silicate which exceeded the range of number average primary particle diameter specified in the present invention as the external additive.

To the contrary, the toners of Examples 1 to 4 could prevent damage of the photosensitive members and filming, hardly caused deterioration of image quality, and was excellent in printing durability, since the toners of Examples 1 to 4 used the magnesium silicate specified in the present invention as the external additive.

The invention claimed is:

1. A positively-chargeable toner for developing electrostatic images comprising colored resin particles containing a colorant and a binder resin, and an external additive, wherein the external additive contains talc having negatively charging ability, the talc having a number average primary particle diameter in the range from 1 to 7 μm, wherein the talc is contained at an amount of 0.23 to 1 parts by weight with respect to 100 parts by weight of the colored resin particles; and wherein an average circularity of the colored resin particles is in the range from 0.960 to 0.995, and a particle size distribution (Dv/Dn), which is the ratio of a volume average particle diameter "Dv" and a number average particle size "Dn" of the colored resin particles, is in the range from 1.0 to 1.3.

2. The positively-chargeable toner for developing electrostatic images according to claim 1, wherein the external additive further contains silica particles (A) having a number average primary particle diameter of 5 to 20 nm, and silica particles (B) having a number average primary particle diameter of 25 to 70 nm.

3. The positively-chargeable toner for developing electrostatic images according to claim 2, wherein a content of the silica particles (A) is in the range from 0.3 to 2 parts by weight and a content of the silica particles (B) is in the range from 0.5 to 3 parts by weight with respect to 100 parts by weight of the colored resin particles.

4. The positively-chargeable toner for developing electrostatic images according to claim 1, further comprising a charge control resin having positively charging ability.

5. The positively-chargeable toner for developing electrostatic images according to claim 4, wherein the charge control resin having positively charging ability is a quaternary ammonium base-containing copolymer.

* * * * *